US005826399A

United States Patent [19]

Dahl

[11] Patent Number: 5,826,399

[45] Date of Patent: Oct. 27, 1998

[54] NOISE-REDUCING BARRIER CONSTRUCTION

[76] Inventor: Staffan Dahl, Renlavsgången 36, Tyresö, Sweden, 135 35

[21] Appl. No.: 700,410

[22] PCT Filed: Mar. 22, 1995

[86] PCT No.: PCT/SE95/00300

§ 371 Date: Sep. 25, 1996

§ 102(e) Date: Sep. 25, 1996

[87] PCT Pub. No.: WO95/26443

PCT Pub. Date: Oct. 5, 1995

[30] Foreign Application Priority Data

Mar. 25, 1996 [SE] Sweden ..... 9401019

[51] Int. Cl.[6] ..... E04B 1/00

[52] U.S. Cl. ..... 52/745.1; 52/747.1; 52/79.2; 52/271; 52/266; 405/284

[58] Field of Search ..... 52/300, 271, 266, 52/79.3, 79.2, 479, 745.05, 745.08, 745.09, 745.1, 745.13, 747.1; 405/272, 284

[56] References Cited

U.S. PATENT DOCUMENTS

| | | | |
|---|---|---|---|
| 889,870 | 6/1908 | Chiodo . | |
| 3,702,523 | 11/1972 | McCaul, III et al. | 52/271 X |
| 3,818,658 | 6/1974 | Slaven | 52/606 |
| 5,261,205 | 11/1993 | Sandor | 52/271 X |
| 5,403,127 | 4/1995 | Knudsen | 405/286 |
| 5,647,695 | 7/1997 | Hilfiker et al. | 405/284 |

FOREIGN PATENT DOCUMENTS

| | | |
|---|---|---|
| 0127978 | 12/1984 | European Pat. Off. . |
| 2478698 | 9/1981 | France . |
| 2744335 | 4/1979 | Germany . |
| 366359 | 4/1974 | Sweden . |

*Primary Examiner*—Lanna Mai

*Attorney, Agent, or Firm*—Jacobson, Price, Holman & Stern, PLLC

[57] ABSTRACT

A noise-reducing barrier construction with prefabricated construction elements is disclosed. The barrier construction is placed on the ground, e.g. adjacent to a road. Each box-like construction element is made of wood and comprises a bottom section (10) and at least one upper section (20, 30). The frames of the vertically stacked sections engage with each other, so that the sections are mutually fixed and the side walls (25, 26) are kept intact when the inner space is filled with sand or the like.

5 Claims, 2 Drawing Sheets

NOISE-REDUCING BARRIER CONSTRUCTION

The present invention concerns a prefabricated construction element for building a noise-reducing barrier construction on the ground, comprising a box-like unit having at least two vertically stackable sections, viz. a bottom section and at least one upper section, to be filled with sand or the like.

The invention also concerns a method of building such a barrier construction by means of box-like units.

The noise-reducing barrier construction is primarily intended to be disposed adjacent to roads for isolating and reducing traffic noise, so that nearby areas, e.g. residential areas, will be disturbed as little as possible. The barrier construction can of course be used for other, similar purposes, such as at railroads, airports, adjacent to noise-generating factories etc.

As an alternative to the conventional method of providing noise-reduction by means of an embankment of soil or filling material, it is known to build a barrier construction by means of concrete elements, either as ready to use wall elements (see FR-A-2 478 698) or as box-like units intended to be filled with sand or the like. A box-like concrete element of the latter kind is described in DE-A1–27 44 335, wherein prefabricated, relatively large and heavy concrete elements are positioned in a row so as to form a barrier construction. Each element usually consists of two side walls, which are inclined towards each other and which are held at a well defined mutual distance by cross-members serving as frame elements, and which form an upper elongated opening, through which soil, gravel or other filling material can be introduced. Thereupon, it is possible to grow plants in the longitudinal upper opening, and it is also possible to provide the side wall portions with external pockets, where further plants can be arranged as decoration.

The filling material will contribute substantially to an effective noise reduction in that sound waves are damped and to a certain extent absorbed inside the material, so that the wall material itself can be made relatively thin. Nevertheless, the moulded concrete elements are voluminous and heavy to transport and handle in connection with mounting of the noise barrier. Special equipment will be required, e.g. a lorry with a specially formed crane. The total cost for such a barrier construction, including mounting thereof, will therefore be relatively high.

Another noise-reducing barrier, likewise comprising moulded concrete elements, is described in SE-B-366359. Here, each boxlike element, to be filled with sand or other filling material, consists of at least two vertically stackable sections. Each such section is relatively easy to handle in connection with transport and mounting. However, each section is narrower at the base than at the top of the underlying section so as to provide open side portions where bushes or other plants can be grown. The filling material will therefore absorb rain, and will thus contain water, at least periodically. For this reason, the sections must be made of concrete or some other damp proof or weather resistant material. Furthermore, the sound insulating capacity of the filling material will be reduced because of the water contents.

Against this background, it is an object of the present invention to achieve a construction element, which is easier and less expensive to manufacture and which is even easier to transport, and still handy to mount. Moreover it should be relatively inexpensive in finished form and have a long life.

According to the invention, this object is achieved in that said construction element is made substantially of wood, each upper section (20, 30) comprising a wooden frame (11-15; 21–24; 31–34), reinforced by metal fittings and having substantially vertical frame parts, the lower or upper end portions of which are extended so as to engage with the frame of the respective overlying or underlying section (10, 20), and wall panels (25, 26, 35, 36), which are securely anchored to the wooden frame and are made of a light, weather-proof material, said wall panels comprise vertical end wall panels (26, 36) and inclined side wall panels (25; 35), the latter being inclined inwardly towards each other so that each upper section (20, 30) forms a box-like, upwardly tapering section; said vertically stacked sections adjoin each other, so that the whole construction element tapers upwardly with inwardly inclined side walls and an interior, unitary space is formed, into which said sound damping filling material is filled; and the uppermost section (30), upon filling said interior space with said filling material, is provided with a covering lid (40) of water-tight, weather-proof material, so that the entire construction element, including the filling material, is kept dry.

The stackable elements can be transported and, above all, handled in a very simple manner. Each section can be loaded, unloaded, lifted and mounted manually by two persons or even by a single person, owing to the fact that relatively light materials are used, in particular wooden materials. The mutually engaging frame portions ensure that the sections are automatically correctly positioned during the mounting process. Moreover, the sections are maintained in mutually correct positions during filling of sand. Mounting and filling of sand can therefore be performed swiftly and easily, so that the total cost, including mounting, can be held at a very low level.

The wooden frame of each upper section is reinforced by metal fittings, whereas the wall panels are preferably made of plywood. The bottom section may comprise frame parts which are mutually connected by means of metal fittings, e.g. angled fittings.

Such construction elements of wood may preferably be prefabricated by standard house manufacturers having the necessary workshop equipment and experience of manufacturing of building elements in series production. The manufacturing cost can then be reduced to a very favourable, low level.

In principle, it is possible to use other relatively light, strong and weather resistant materials than plywood panels, e.g. fibre boards, possibly of mixed materials.

A very simple and advantageous embodiment is provided, wherein each upper section has vertical frame portions, the lower end portions of which are extended so as to engage with the frame of the underlying section. Alternatively, substantially vertical frame members may project upwards somewhat above the side walls so as to engage with the overlying section.

Each section has an upper opening, so that the sections stacked to the desired height together form an inner, unitary space to be filled with sand. The opening of the uppermost section is closed with a lid of a water-tight, weather proof material, e.g. sheet metal, so that the entire barrier construction with sand contained therein is kept dry. Hereby, the life is extended considerably.

When a noise-reducing barrier construction is to be built, it is suitable to start by providing a bed of gravel on the ground, so that the foundation is drained and is kept dry and stable. Thereupon, one or more bottom sections are positioned onto the gravel bed, preferably in an exactly horizontal position. However, in case of slightly sloping ground portions, it is possible to let each construction element be inclined to a corresponding degree, so that the upper surface or edge of the barrier construction slopes in parallel to the ground plane. Possibly, a damp proof isolation slab is placed on the gravel bed, so that moisture is prevented from being absorbed in the filling material or in the frame of the bottom section. Apparently, the bottom sections can be relatively low, in particular as a base element, which facilitates the important work involving vertical and horizontal positioning of the barrier. Thereupon, one or more upper sections are placed onto each bottom section, the frames of the respective upper section and the adjacent, underlying section engaging with each other, so that the stacked sections are mutually fixed in correct positions. At this stage, no measuring has to be made, since the position of each upper section is uniquely defined by the position of the underlying section and the mutually engaging frame portions. Finally, sand or corresponding sound damping filling material is introduced through the upper, rectangular opening of the uppermost section. The filling can be made directly from the tipping platform of a truck, provided that the opening is sufficiently large, or via a chute, a conveyor belt, a tube or a flexible hose or the like. Finally, the opening is closed or sealed off with a lid of sheet material or some other tight and weather resistant material.

In order prevent that a gap is formed between to adjacent construction elements, the adjacent end frame portions of the adjoining upper sections are suitably secured to each other, so that the elements are retained in abutting relationship to each other, during the filling operation as well as afterwards.

The invention will be explained more fully below with reference to the attached drawings illustrating a preferred embodiment.

Figure 3:
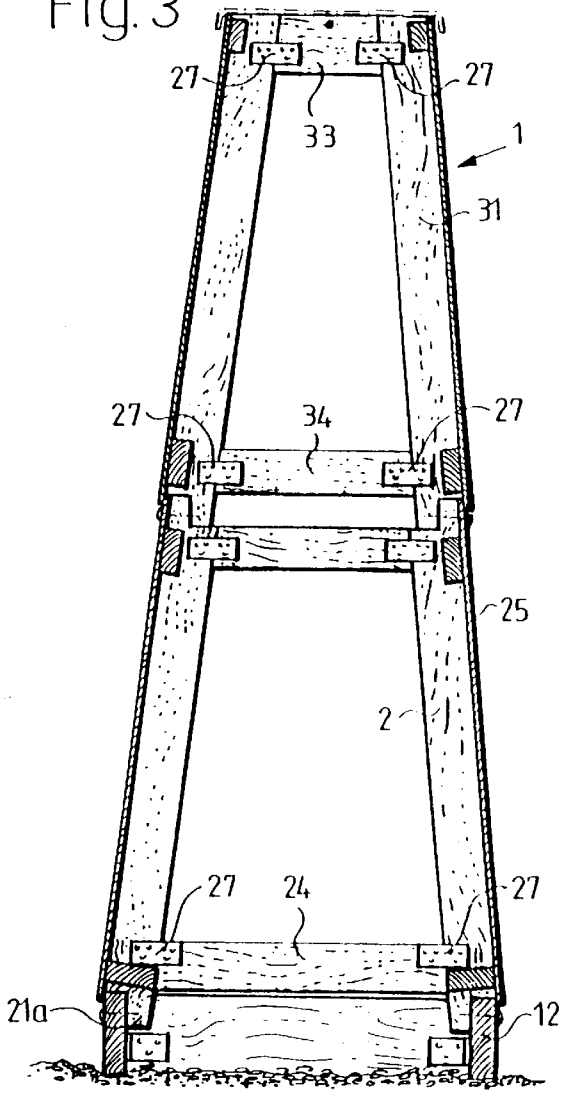
Figure 1:
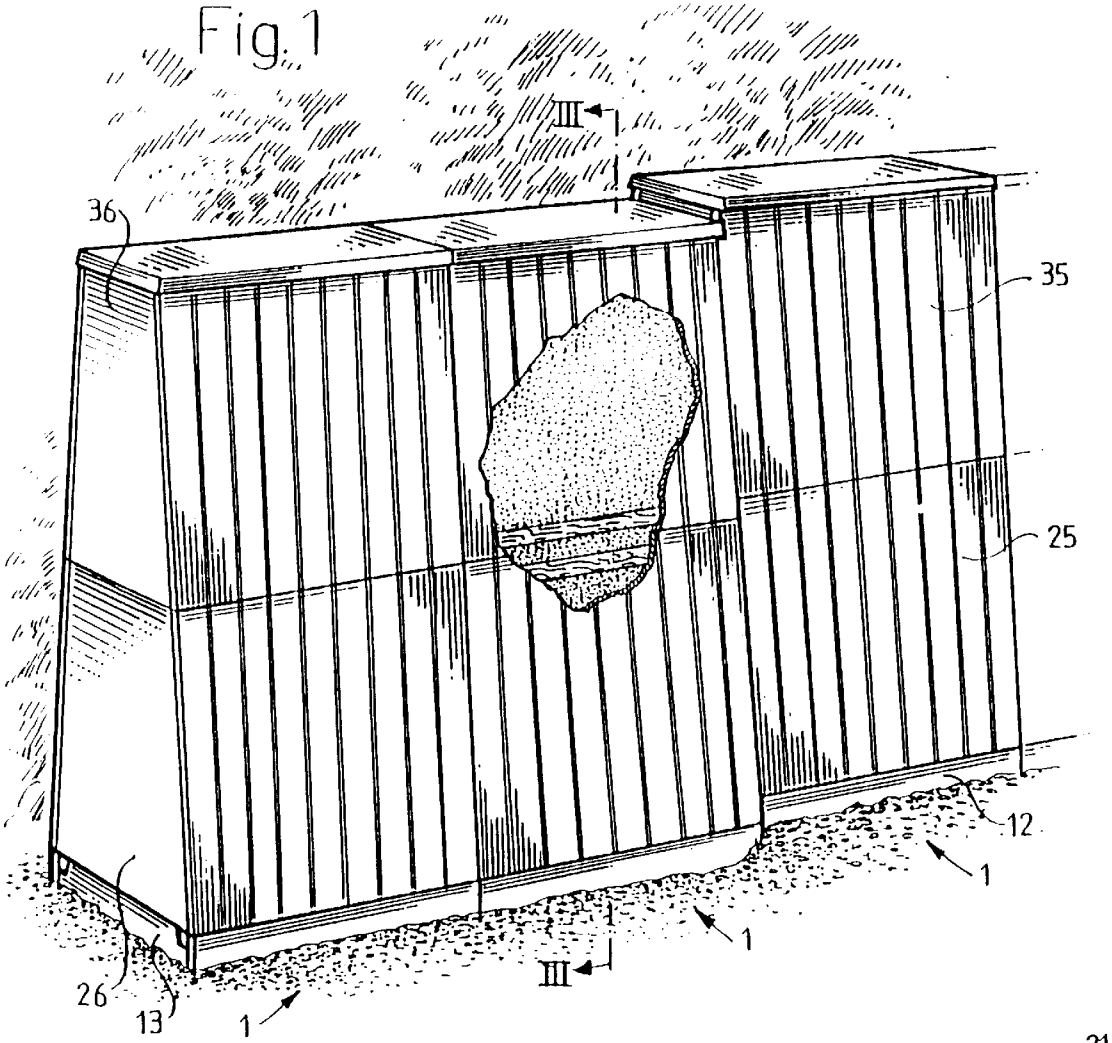
FIG. 1 shows a portion of a barrier construction in a perspective w, one of the construction elements according to the invention being partially cut so as to illustrate the internal space being filled with sand.

FIG. 3 flows a cross-section through the barrier construction of FIG. 1 (prior to filling with sand) along the line III—III in FIG. 1.

Figure 2:
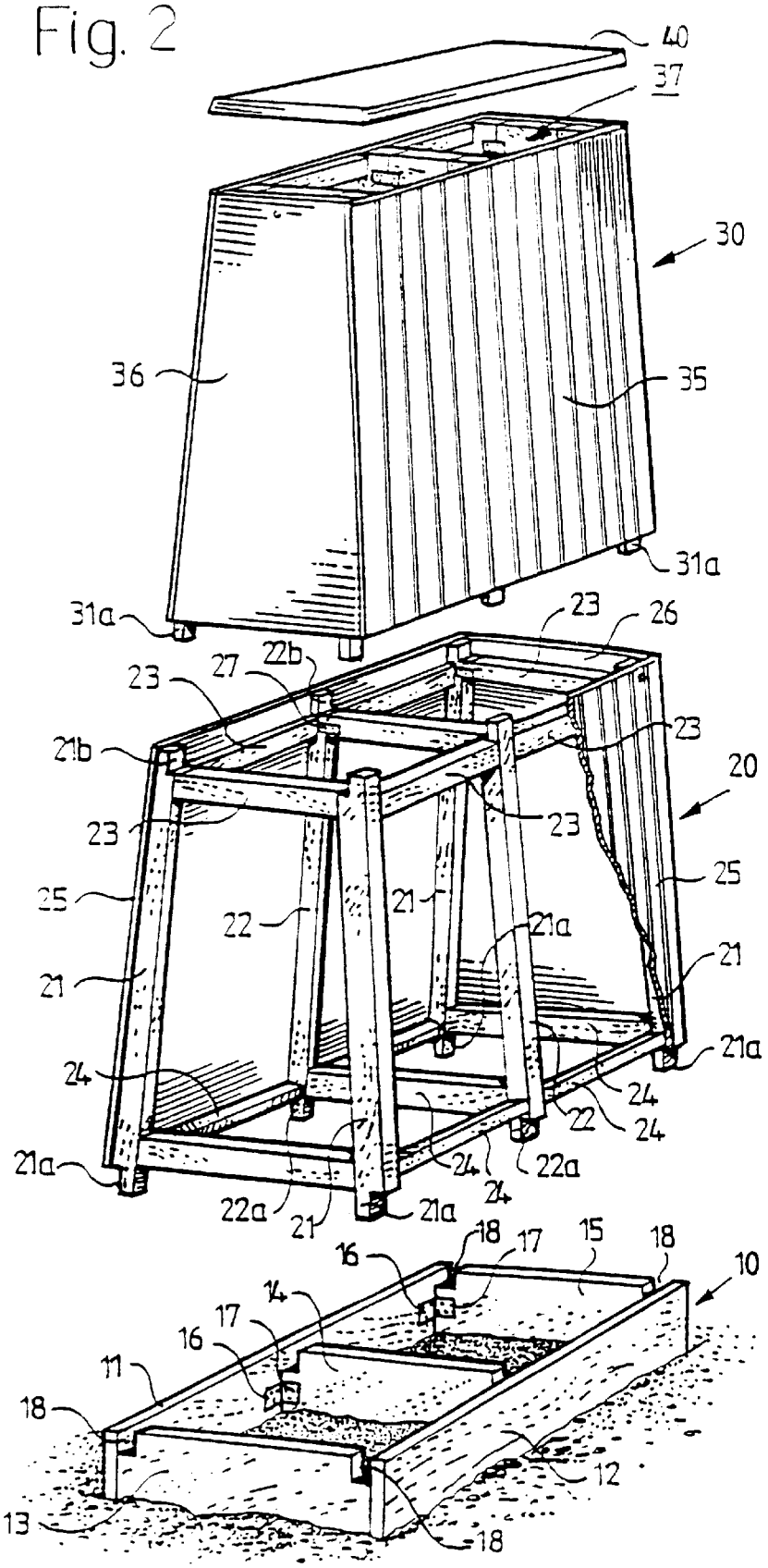
FIG. 2 shows the construction element according to the invention in a perspective, exploded view (without filling sand)

The sound damping barrier construction illustrated on the drawings is formed by construction elements 1 being positioned in a row and each being made of wood and consisting of three sections stacked vertically, namely a lower bottom section 10 serving as a base, a first upper section or mid section 20, a second upper section 30 as well as a lid 40 (compare FIG. 2).

In this case, the bottom section 20 consists of beams or frame timber elements 11, 12, 13, 15 with a height of 220 mm. The longitudinal frame elements have a length of 1200 mm, whereas the transversal frame elements or stubs 13, 14, 15 have a length of 860 mm, so that the bottom section has the external dimensions 1200=950 mm (the frame timber elements have the dimensions 45=220 mm). The stubs 13, 14, 15 are secured to the longitudinal frame timber elements 11, 12 by means of angled fittings 16 and associated screws 17. The three stubs 13, 14, 15 have, at their ends adjacent to the longitudinal frame timber elements, upper recesses 18 adapted to receive downwardly projecting end portions of the vertical frame posts of the adjacent upper section. The dimensions of the bottom section may of course be modified at wish, and the number of stubs may also be extended if the section is made longer.

The mid section 20 has corresponding dimensions in relation to the bottom section 10, although it is much higher and has side walls being inclined towards each other. The frame of the mid section comprises six substantially vertical (inclined inwardly approximately 60) elements or posts, viz. four corner posts 21 and two mid posts 22, the lower end portions of which are recessed externally, so that hook portions 21*a* and 22*a*, respectively, fitting into the recesses 18 of the bottom section, are formed. The posts 21, 22 are mutually connected by means of horizontal, upper and lower stubs 23 and 24, respectively. These stubs 23, 24 are secured to the posts 21, 22 by oblique nails (the nails are not shown on the drawing). Moreover, the transverse stubs 23, 24 are anchored to the posts 21, 22 by means of nail joint fittings 27. Compare FIG. 3. The upper ends of the posts have internal recesses 21*b* and 22*b*, respectively, and the upper stubs 23 are situated somewhat below the upper ends of the posts, so that the frame posts of the upper section 30 can be inserted with its end portions adjacent to the recesses 21*b*, 22*b* (compare also FIG. 3).

On the frame 21, 22, 23, 24 of the mid section 20, wall panels are secured by means of an adhesive agent and a plurality of (non-illustrated) nails. The wall panels are made of plywood, thickness 12 mm, provided with vertical grooves giving an impression of vertical boarding. This is true for the side walls 25, but not for the end walls 26. Of course, it is possible to use other kinds of wooden based panels or panels of other lightweight weather proof materials.

The upper section 30 is constructed in the same way as the mid section 20 and therefore it is not necessary to describe the details thereof. Because of the inward inclination of the side walls, this section is somewhat narrower. Its side walls are denoted the reference numeral 35, and its end walls are denoted 36, whereas the downwardly projecting post portions are denoted 31*a*. The posts (in FIG. 3) are denoted 31 and the stubs 33, 34. The upper section 30 has an upper, rectangular opening 37, through which sand is filled upon mounting of the sections 10, 20 and 30. Compare also FIG. 1, where the sand is indicated inside the cutout wall portion.

As described above, the upper opening 37 of each construction element (consisting of the sections 10, 20, 30) is closed by a lid 40 of sheet material, which is secured by sheet nails (not shown). If desired, the lid may be integrated with a top section, which may be designed at will in consideration of functional and aesthetic requirements. The total height of the barrier should of course be adapted to the particular, local circumstances. In order to isolate and damp traffic noise, the height should be at least 2 m, preferably 2.5 m or more.

Each construction element 1 may consist of only two sections, viz. a bottom section and a corresponding upper section, or a bottom section in combination with three or more upper sections stacked one on top of the other. Of course, the framework of each section can be modified by those skilled in the art in many ways as may the method of fitting the frame portions together and the method of fitting the wall panels onto the frames. The mutual engagement of the frames may also be varied.

When several construction elements 1 are joined to each other in a straight row, it is quite possible and even advantageous to connect the longitudinally adjoining frame portions to each other and leave out the end walls (36, FIG. 2) except for the end walls constituting the ends of the whole row.

In order to secure a long life of the construction elements, all wooden parts are preferably treated or impregnated with a preservative agent, e.g. by pressure impregnation.

I claim:

1. A method of building a noise-reducing barrier construction on the ground, wherein box-like construction elements are positioned adjacent to each other in a row and are filled with a sound damping filling material, said method comprising providing a gravel bed on the ground, placing a bottom section of each construction element on the gravel bed, stacking one or more upwardly, inwardly tapering construction element sections of wooden material on top of the bottom section, each upper section and an adjacent underlying construction element section having wooden frames engaging with each other, so that the stacked sections are fixed in position, said upper sections comprising inwardly inclined wall panels, which securely anchored to the wooden frame and adjoining each other horizontally and vertically, filling said filling material into an upper opening of an uppermost one of said one or more upper construction element sections, and covering said upper opening by a lid made of a water-tight, weather-proof material, so that the barrier construction, including the filling material, is kept dry.

2. Prefabricated construction element for building a noise-reducing barrier construction element for building a noise-reducing barrier construction on the ground, comprising at least two vertically stackable sections including a bottom section and at least one upper section, to be filled with a sound damping filling material, said construction element being made substantially of wood, each upper section comprising a wooden frame, reinforced by metal fittings and having substantially vertical frame parts, at leas one of a lower end portion and an upper end portion of said frame parts extending so as to engage with the wooden frame of one of an overlying section and an underlying section , and wall panels securely anchored to the wooden frame and being made of a light, weather-proof material, said wall panels comprise vertical end wall panels and inclined side wall panels, the inclined side wall panels being inclined inwardly towards each other so that each of said at least one upper section forms a box-like, upwardly tapering section;

said vertically stacked sections adjoin each other, so that the construction element tapers upwardly with inwardly inclined side walls and an interior, unitary space being formed, into which said sound damping filling material is filled; and an uppermost one of said at least one upper section , upon filling said interior space with said filling material, being provided with a covering lid of a water-tight, weather-proof material, so that the construction element, including the filling material, is kept dry.

3. Construction element as defined in claim 2, wherein said wall panels are made of plywood.

4. Construction element as defined in claim 2, wherein the bottom section comprises frame parts which are mutually connected by metal fittings.

5. Construction element as defined in claim 2, wherein the wall panels are anchored to the wooden frame of each said at least one upper section by an adhesive agent in combination with fasteners.

* * * * *